US008312690B1

(12) United States Patent
Klemaske, II et al.

(10) Patent No.: US 8,312,690 B1
(45) Date of Patent: Nov. 20, 2012

(54) PERVIOUS CONCRETE SYSTEM AND METHOD OF FORMING PERVIOUS CONCRETE

(75) Inventors: Byron A. Klemaske, II, San Diego, CA (US); Victor Alvin Klemaske, San Diego, CA (US); Christina Palpal-latoc, San Diego, CA (US); Andrew Weber, Chula Vista, CA (US)

(73) Assignee: T.B. Penick & Sons, Inc., San Diego, CA (US)

( * ) Notice: Subject to any disclaimer, the term of this patent is extended or adjusted under 35 U.S.C. 154(b) by 0 days.

(21) Appl. No.: 13/443,799

(22) Filed: Apr. 10, 2012

Related U.S. Application Data

(60) Provisional application No. 61/605,046, filed on Feb. 29, 2012.

(51) Int. Cl.
*E04G 21/00* (2006.01)

(52) U.S. Cl. ..... 52/741.41; 404/82

(58) Field of Classification Search ..... 52/315, 52/596, 612, 741.41; 404/17, 20, 82; 428/312.2, 428/312.4, 312.6
See application file for complete search history.

(56) References Cited

U.S. PATENT DOCUMENTS

| | | | | |
|---|---|---|---|---|
| 3,870,422 | A * | 3/1975 | Medico, Jr. | 404/31 |
| 4,748,788 | A | 6/1988 | Shaw et al. | |
| 5,788,407 | A * | 8/1998 | Hwang | 404/81 |
| 6,016,635 | A | 1/2000 | Shaw et al. | |
| 6,033,146 | A | 3/2000 | Shaw et al. | |
| 6,102,613 | A * | 8/2000 | Medico et al. | 404/17 |
| 6,206,607 | B1 * | 3/2001 | Medico et al. | 404/2 |
| 6,790,544 | B2 * | 9/2004 | Schmitz | 428/703 |
| 7,168,884 | B2 * | 1/2007 | Hart | 404/29 |
| 2002/0152711 | A1 * | 10/2002 | Schmitz | 52/612 |
| 2007/0223998 | A1 * | 9/2007 | Hartenburg | 404/31 |
| 2010/0112329 | A1 * | 5/2010 | Yi | 428/312.4 |
| 2011/0038668 | A1 * | 2/2011 | Exline et al. | 404/17 |
| 2011/0064517 | A1 * | 3/2011 | Sader | 404/28 |

OTHER PUBLICATIONS

Klemenc, Stacey Enesey, Feature Stories: Pretty and Pervious: Decorative Options for Pervious Concrete, Concrete Decor Magazine, Feb./Mar. 2010, vol. 10, No. 2.

* cited by examiner

*Primary Examiner* — Jeanette E Chapman
*Assistant Examiner* — Daniel Kenny
(74) *Attorney, Agent, or Firm* — Knobbe, Martens, Olson & Bear, LLP

(57) ABSTRACT

Various embodiments of a system and method of forming a decorative pervious concrete system are generally described. In some embodiments, the pervious concrete system comprises a coarse pervious layer, a binder layer, a decorative pervious layer and a decorative layer sealer. In some embodiments, the decorative pervious layer comprises a decorative aggregate which may be at least partially exposed.

20 Claims, 2 Drawing Sheets

PERVIOUS CONCRETE SYSTEM AND METHOD OF FORMING PERVIOUS CONCRETE

BACKGROUND OF THE INVENTION

1. Field of the Invention

The present disclosure relates to a pervious concrete system and a method of forming a pervious concrete system.

2. Description of the Related Art

Concrete is a common construction, building, and landscape material that generally is impervious or has little permeability for water passage through the concrete. In construction, building, landscaping, or other application where a water-permeable or porous surface is desired or required, traditional concrete cannot be used. Therefore, the need exists for a concrete material which retains the strength and performance of concrete and also provides for water-permeability or perviousness.

SUMMARY OF THE INVENTION

Some embodiments disclosed herein include a pervious concrete system comprising: a sub-grade layer; a coarse pervious layer, disposed on the sub-grade layer, comprising: a coarse aggregate, a cement mixture, a fiber material, and water of hydration, wherein the coarse aggregate, cement mixture, fiber material and water create a pervious concrete layer; a binder layer, the binder layer being disposed on the coarse pervious layer; a pervious decorative top layer, disposed on the binder layer, comprising: a decorative aggregate, the decorative aggregate having an average particle size smaller than that of the coarse aggregate, a pozzolan, an internal curing admixture, a fiber material, and water of hydration, wherein the decorative aggregate, pozzolan, internal curing admixture, fiber material are distributed throughout the decorative top layer and create a pervious concrete layer.

In some embodiments, the binder layer comprises an acrylic.

In some embodiments, the decorative top layer further comprises an alkali silica reaction control admixture.

In some embodiments, the pervious concrete system further comprises at top seal layer comprising a lithium sealer.

In some embodiments, the decorative aggregate is a decorative glass.

In some embodiments, the alkali silica reaction control admixture is lithium nitrate.

In some embodiments, the decorative pervious layer further comprises a hydration stabilizer.

In some embodiments the hydration stabilizer comprises an aqueous hydroxycarboxylic acid salt solution.

In some embodiments, the coarse aggregate has an average particle size from about ¼ inch to about 1½ inches.

In some embodiments, the pozzolan is fly ash.

In some embodiments the coarse aggregate layer if formed having a void space of about 18% to about 22%.

In some embodiments the decorative pervious layer is formed having a void space of about 15% to about 25%.

In some embodiments the percolation rate of water through the pervious concrete system is greater than about 5 gallons per hour per square foot.

In some embodiments, the design water to cementitious material ratio in the coarse pervious layer is about 0.25 to about 0.4.

In some embodiments, the design water to cementitious material ratio in the decorative pervious layer is about 0.25 to about 0.45.

Some embodiments disclosed herein include a method of forming a pervious concrete system comprising: establishing a sub-grade layer on which the pervious concrete will be formed; disposing a coarse pervious layer on the sub-grade layer, wherein the coarse aggregate layer comprises cement, a relatively coarse aggregate and a fiber; retaining water of hydration in the coarse pervious layer during curing by applying an acrylic binder layer to the coarse pervious layer; disposing a decorative pervious layer on to the acrylic binder layer, the decorative pervious layer comprising a cement, a relatively fine decorative aggregate, fly ash, and an internal curing admixture; retarding curing of a top surface of the decorative pervious layer by applying a retarder, and allowing a remaining portion of the to cure to a greater extent than the top surface; and thereafter mechanically removing at least a portion of the top surface of the decorative pervious layer to at least partially expose the decorative aggregate; and washing the decorative top layer.

In some embodiments the decorative pervious layer further includes an alkali silica reactivity control admixture.

In some embodiments, the method further includes applying a top seal layer to the decorative pervious layer.

In some embodiments mechanically removing comprises brushing the surface of the decorative pervious layer.

In some embodiments at least partially exposing the decorative aggregate comprises exposing at least a top surface of the decorative aggregate.

DETAILED DESCRIPTION OF THE PREFERRED EMBODIMENT

Figure 1:
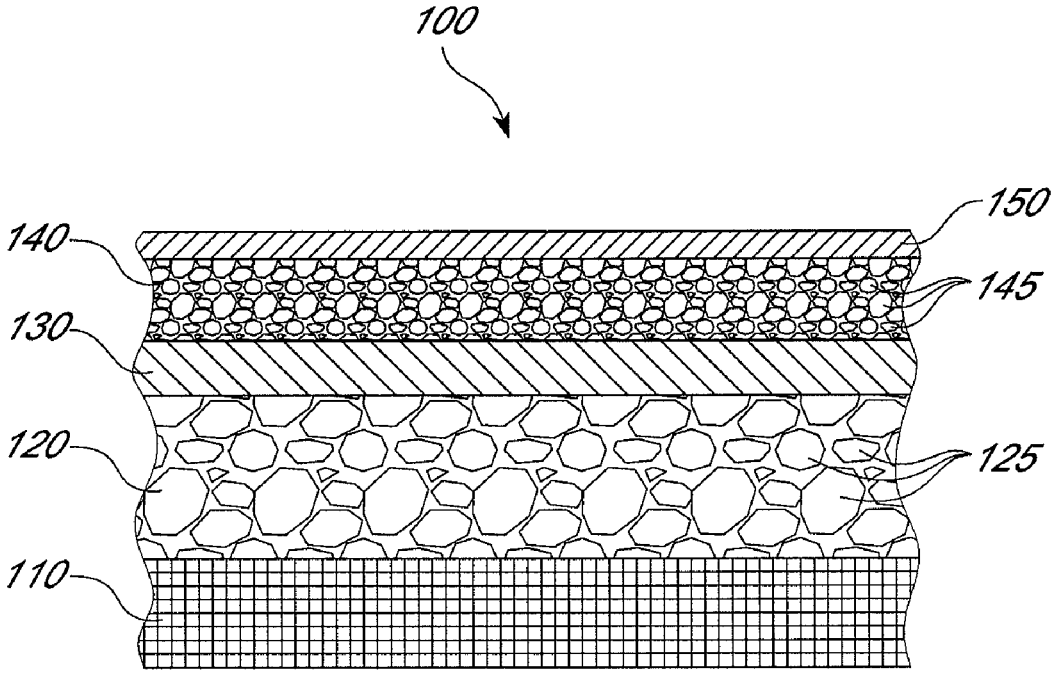
FIG. 1 depicts a cross-sectional view of an embodiment of a pervious concrete system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Disclosed in the present application is a pervious concrete system and a method for forming a pervious concrete system.

Although certain embodiments of the present invention are shown and described in detail, it should be understood that various changes and modifications may be made without departing from the scope of the appended claims. The scope of the present application is in no way limited to the number of constituting components, the materials thereof, the quantities thereof, the relative arrangement thereof, etc. Generally, the term cement is used to denote the material used to bind together the aggregate materials in concrete. For example, herein the term cement may refer to a mixture comprising portland cement, hydrated lime, calcium aluminate cement, calcium sulfoaluminate cement, pozzolan-lime cement, or any other commonly known or used cement in masonry, concrete, grout, plaster, or any combination of the foregoing. Also, it is contemplated that some embodiments may not include all of the recited materials, thus sub-combinations of the listed materials are contemplated. For example, certain materials, including one or more of the fiber material, the pozzolan, the internal curing admixture, and the hydration stabilizer may be substituted by other materials or simply eliminated in certain specific embodiments. The term average particle size may mean the average size of the particles measured along an axis when the particles are not substantially round or spherical. Average particle size may mean a spherical equivalent diameter obtained by methods well known in the art for estimating particles as being substantially round or spherical. Average particle size may additionally refer to, an industry standard measurement. For example, a coarse aggregate may be labeled or referred to as a 1-inch coarse aggregate. In a 1-inch coarse aggregate, many particles of the aggregate may have a size of about 1 inch, but 1 inch is not necessarily the true average particle size in the 1-inch coarse aggregate.

Embodiments of the pervious concrete system may comprise a decorative pervious concrete which has desirable aesthetic elements and desirable hydrologic properties. Some embodiments of a pervious concrete system may comprise a sub-grade layer, a coarse pervious layer, a binder layer, a decorative pervious layer, and a top seal layer. In some embodiments, the coarse pervious layer and the decorative pervious layer are formed with void space between the aggregate particles such that water can percolate through the layers of the pervious concrete system and into the sub-grade layer and eventually into the material upon which the sub-grade layer is disposed.

Referring to the Figures, FIG. 1 depicts a cross-sectional view of an embodiment of a pervious concrete layer 100. Pervious concrete system 100 comprises a sub-grade layer 110, a coarse pervious layer 120, a binder layer 130, a decorative pervious layer 140, and a top seal layer 150. Sub-grade layer 110 can be any suitable base layer on which concrete can be formed. Sub-grade layer 110 may comprise gravel, soil, sand, clay, or other suitable material. Sub-grade layer 110 may be prepared for use by tamping, compressing, treating with a pozzolan, cement or suitable material, or by another appropriate method. Because the concrete system is pervious to water, sub-grade 110 may be contoured, graded, or otherwise engineered to allow or promote adequate draining of liquid passing through the pervious concrete system, or to achieve a desired hydrologic property. Suitable sub-grade materials and qualities are determined based on the expected or desired hydrologic properties of the pervious concrete system 100, e.g., maximum expected percolation rate, etc.

Coarse pervious layer 120 is disposed directly on top of sub-grade layer 110. Coarse pervious layer 120 may comprise a coarse aggregate 125, a fiber material, a fine aggregate, an internal hydration stabilizer, water of hydration, and a cement to bind and harden coarse pervious layer 120. Coarse aggregate 125 may comprise rock, gravel, crushed stone, slag, manufactured rock, or other suitable material, whether natural, manufactured, or recycled. The size of coarse aggregate 125 may vary. In some embodiments, the average particle size of coarse aggregate may be from about ¼" to about 1½" or larger. As the average particle size of coarse aggregate 125 increases, the porosity and void space of coarse pervious layer 120 increases. Coarse pervious layer 120 may comprise a void space that is preferably between 5% to 40%. In some embodiments, the void space may be about 18% to about 25%. Void space is generated by using very little or no fine aggregate in the coarse pervious layer 120, by controlling the size of decorative aggregate 145 and by varying the design water to cementitous material (w/c) ratio. The design w/c ratio for coarse aggregate layer 120 may be from about 0.2 to about 0.4. Using a coarse aggregate 125 with a larger average particle size may result in a larger voids in coarse pervious layer 120, which, in turn, may result in a higher percolation rate. In some embodiments, the percolation rate of water through the coarse pervious layer 120 may be greater than about 5 gallons per hour per square foot, as measured by double ring infiltrometer.

The thickness of coarse pervious layer 120 is related to the strength of the pervious concrete system. A thicker coarse pervious layer 120 may result in a stronger concrete system, but may reduce the percolation rate of the pervious concrete. Coarse pervious layer 120 may advantageously be from 2" to 10" thick. In some embodiments, coarse pervious layer 120 may be about 4½ inches thick.

In some embodiments, coarse pervious layer 120 may comprise a fiber material. A fiber material disposed in coarse pervious layer 120 may reinforce coarse pervious layer 120 and provide greater strength, flexibility, durability, or resistance to cracking during freeze-thaw cycles. The fiber material may comprise discrete fibers substantially homogenously mixed into coarse pervious layer 120. The discrete fibers may have an average fiber length of about 1 to about 20 mm. In some embodiments, the average fiber length is about 2.1 mm. In some embodiments, the fiber material may comprise a net or mesh disposed within coarse pervious layer 120. The fiber material may comprise cellulose, wood pulp, coir, bamboo, jute, grass, straw, steel, glass, plastic, polymers such as propylene and nylon, or any other suitable natural or synthetic fiber. In some embodiments, the fiber material may be a cellulose fiber such as Ultrafiber™ manufactured by Buckeye Building Fibers, LLC. In some embodiments, coarse pervious layer 120 may comprise fiber material from about 0.5 to about 5 lbs/yard$^3$ of coarse pervious layer 120. In some embodiments, the fiber material may advantageously comprise about 3 lbs/yard$^3$ of coarse pervious layer.

In some embodiments, coarse pervious layer 120 may comprise a hydration stabilizer. In some embodiments, the hydration stabilizer may act as an internal curing agent. The hydration stabilizer may comprise an aqueous solution of one or more hydroxycarboxylic acids and/or their associated acid salts. The hydroxycarboxylic acid may be citric acid, lactic acid, ascorbic acid, or salts thereof, or any other hydroxycarboxylic acid or salt thereof known in the art. The hydration stabilizer may comprise an aqueous solution of a phosphoric acid, a phosphoric acid salt, or a non-alkaline salt. Coarse pervious layer 120 may comprise a hydration stabilizer in the amount of from about 0 gallons/yard$^3$ to about 3 gallons/yard$^3$.

In some embodiments, the hydration stabilizer may be RECOVER® hydration stabilizer manufactured by Grace Concrete Products.

In some embodiments, coarse pervious layer may comprise rebar, steel plates, or composite materials to provide structural reinforcement. In some embodiments, coarse pervious layer 120 may comprise sand as a fine aggregate. By varying the amount of sand in coarse pervious layer 120, the porosity or void space may be varied to achieve the desired perviousness or percolation rate.

Binder layer 130 is disposed on coarse pervious layer 120. Binder layer 130 may advantageously include a binder, e.g., a latex acrylic binder such as AQUA-CURE VOX manufactured by the Euclid Chemical Company. In some embodiments, binder layer 130 acts as curing and sealing agent. In some embodiments, binder layer 130 acts to bind coarse pervious layer 120 to decorative pervious layer 140. In some embodiments, binder layer 120 may be a liquid which is sprayed directly on to coarse pervious layer 120 up to a thickness of about 0.25-10 mils. Binder layer 130, when applied to coarse pervious layer 120, is sufficiently porous as to not hinder the percolation rate of coarse pervious layer 120.

In some embodiments, binder layer 130 may aid in maintaining the integrity of pervious concrete system 100 during freeze-thaw cycles. Binder layer 130 may retain water of hydration within coarse pervious layer 12Q to promote and ensure proper curing of coarse pervious layer 120. In some embodiments, binder layer 130 promotes proper curing of decorative pervious layer 140. During curing of coarse pervious layer 120 and decorative pervious layer 140, coarse pervious layer 120 may extract water of hydration or moisture from decorative pervious layer 140, resulting in improper curing of decorative pervious layer 140. Applying binder layer 130 to coarse pervious layer 120 creates a moisture barrier which minimizes the amount of moisture the coarse pervious layer 120 extracts from the decorative pervious layer 140 during curing.

Decorative pervious layer 140 is disposed on binder layer 130 and coarse pervious layer 120. Decorative pervious layer 140 may comprise one or more of a decorative aggregate 145, a pozzolan, a hydration stabilizer, an internal curing admixture, an alkali silica reaction (ASR) control admixture, and a fiber material, which are mixed together and substantially uniformly distributed such that decorative pervious layer 140 comprises a substantially homogeneous layer. In some embodiments, decorative pervious layer 140 may comprise a surface retarder.

Decorative aggregate 145 may comprise about 20% to about 90% by weight of decorative pervious layer 140. In some embodiments, decorative aggregate may preferably comprise from about 70% to about 85% by weight of decorative pervious layer 140. In some embodiments, decorative aggregate 145 may have an average particle size less than the average particle size of coarse aggregate 125, and may comprise particles having a very small size, such as sand or fine gravel that is 1/10 inch or less. In some embodiments, the average particle size of decorative aggregate 145 may be from about 4.75 mm to 3/8 inch. The decorative aggregate may comprise volcanic rock, polished rock, basalt, quartz, granite, limestone, crushed stone, sea shells, amber, aquarium rock, tile, glass, colored glass, or other material. The list of decorative aggregates is illustrative. A person having skill in the art will understand that many other materials may be suitably used as decorative aggregate without departing from the scope of this disclosure.

In some embodiments, more than one type of decorative aggregate may be used in decorative pervious layer 140. In some embodiments, decorative aggregate 145 may comprise one decorative aggregate in combination with another decorative aggregate. For example, decorative aggregate 145 may comprise a mixture of glass and granite aggregate. In this example, decorative aggregate 145 may comprise from about 1% glass to 100% glass, with the balance being another aggregate.

Decorative aggregate 145 may be arranged within decorative pervious layer 140 to create patterns, shapes, pictures or other similar design features on the pervious concrete surface. In some embodiments, a pervious concrete system may comprise a decorative pervious layer having varying decorative aggregates arranged to form a desired shape or pattern. In some embodiments, the decorative aggregate may be substantially uniformly distributed to provide a substantially uniform surface pattern.

Decorative pervious layer 140 may comprise a pozzolan, such as Class C fly ash, Class F fly ash, slag, rice hull ash, silica fume, metakaolin, or other suitable pozzolan. The presence of a pozzolan in decorative pervious layer 140 acts like a cement and helps mitigate the undesirable ASR which may cause undesirable expansion, swelling, cracking, or spalling of decorative pervious layer 140. Incorporation of a pozzolan, such as fly ash, to mitigate ASR allows for a greater range of decorative aggregate to be useable in decorative pervious layer 140. Because glass is silica based, the presence of glass in decorative top layer 140 may increase the occurrence of ASR. By adding a pozzolan such as fly ash, glass may be used in decorative pervious layer 140 without experiencing significant undesirable consequences due to ASR.

Decorative pervious layer 140 may comprise a pozzolan in the amount of about 0% to about 75% of cementitious content by weight. In some embodiments, a decorative pervious layer may advantageously comprise from about 1% to about 7%.

Decorative pervious layer 140 may comprise a hydration stabilizer. The hydration stabilizer preserves the workability of the decorative concrete layer by slowing the hydration of the cement. The hydration stabilizer may comprise an aqueous solution of one or more hydroxycarboxylic acids and/or their associated acid salts. The hydroxycarboxylic acid may be citric acid, lactic acid, ascorbic acid, or salts thereof, or any other hydroxycarboxylic acid or salt thereof known in the art. The hydration stabilizer may comprise an aqueous solution of a phosphoric acid, a phosphoric acid salt, or a non-alkaline salt. In some embodiments, the hydration stabilizer may be RECOVER® hydration stabilizer manufactured by Grace Concrete Products.

Decorative pervious layer 140 may comprise an internal curing admixture. The internal curing admixture helps reduce shrinking and cracking during curing, and helps develop desirable characteristics of decorative concrete such as color retention and stronger, sharper corners and edges, compared to decorative concrete without internal curing. Decorative pervious layer 140 may comprise from about 0 gallons/yard$^3$ to about 5 gallons/yard$^3$. In some embodiments, decorative pervious layer 140 may preferably comprise from about ½ gallon/yard$^3$ to about 3 gallons/yard$^3$.

When an internal curing admixture is used in conjunction with a pozzolan, the internal curing admixture retains higher humidity in the concrete while curing, allowing the pozzolanic reaction to occur, giving greater strength and durability to the decorative concrete. In some embodiments, the internal curing admixture may be HydroMax® from ProCure Systems.

Decorative pervious layer 140 may comprise an ASR control admixture. The ASR control admixture may comprise lithium nitrate such as RASIR™ manufactured by Grace concrete products, or EUCON Integral ARC™ from the Euclid Chemical Company. The ASR control mixture mitigates undesirable expansion, swelling, cracking, or spalling due to ASR. In some embodiments, ASR control mixture and a pozzolan are added in complementary amounts such that they work together to mitigate ASR. The ASR control admixture may be present in decorative pervious layer 140 in the amount of about 0 pounds/yard$^3$ to about 5 pounds/yard$^3$. In some embodiments decorative pervious layer may preferably comprise about 3 pounds/yard$^3$. The ASR control admixture may be applied to the surface of decorative pervious layer 140. In these embodiments, the ASR control admixture may comprise a lithium nitrate solution such as EUCO ARC™ manufactured by the Euclid Chemical Company.

Decorative pervious layer 140 is a porous layer, and may comprise a void space of between about 5% to about 40%. In some embodiments, the void space of decorative pervious layer 140 is about 10% to about 30%, preferably about 20%. Void size is the size of the voids formed within the pervious concrete. Although void size may vary based on the size of aggregate used, in some embodiments, the average void size of decorative pervious layer 140 may be less than the average void size of coarse pervious layer 120 in order to prevent dirt, debris, and other particles from infiltrating and plugging the void space of coarse pervious layer 120.

Void space is generated by using very little or no fine aggregate, by controlling the size of decorative aggregate 145, and by varying the design water to cementitous material (w/c) ratio. In some embodiments, the design w/c ratio may be from 0.1 to 0.5. The presence of void space enables pervious concrete system 100 to percolate water through decorative pervious layer 140. In some embodiments, the percolation rate of water through decorative pervious layer 140 may be greater than about 5 gallons per hour per square foot, as measured by double ring infiltrometer. In some embodiments, the percolation rate of water may be from about 1 to about 100 gallons per hour per square foot. In some embodiments the percolation rate of water may be about 1 to about 50 gallons per hour per square foot. In some embodiments, the percolation rate of water may be from about 5 to about 10 gallons per hour per square foot.

Decorative pervious layer 140 may comprise a powder or liquid decorative component incorporated uniformly which imparts a color, hue, texture, sheen, or other visual enhancement.

Pervious concrete system 100 may comprise decorative layer sealer 150. Decorative layer sealer may comprise a lithium-based sealer such as that manufactured by SINAK under the trade name HLQ-125™. Decorative layer sealer 150 is be applied to decorative pervious layer 140. In some embodiments, decorative aggregate 145 is exposed via a process describe elsewhere herein such that the top surface of decorative aggregate is exposed. Decorative layer sealer 150 may be applied to the top surface of decorative pervious layer 140 and the exposed top surfaces of decorative aggregate 145.

Figure 2:
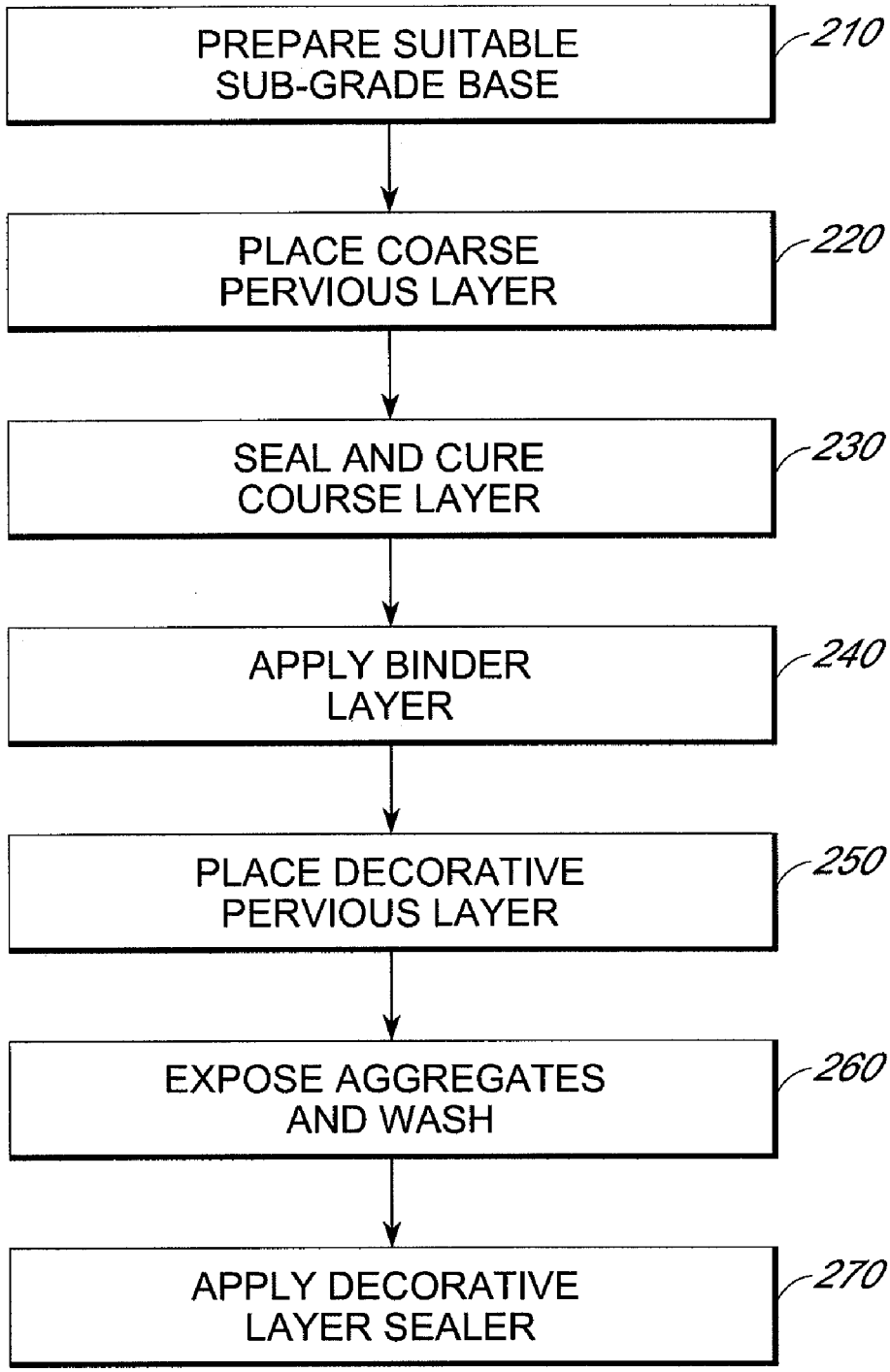
FIG. 2 depicts an embodiment of a method for forming a pervious concrete system.

FIG. 2 depicts a method of forming a pervious concrete system. Referring to FIG. 2, a suitable sub-grade base is formed or prepared in step 210. The sub-grade base may comprise soil, gravel, crushed rock, or other suitable material as described elsewhere herein. The sub-grade base is prepared and may be graded, trenched, or otherwise formed to ensure there is sufficient structural support for the pervious concrete system and to impart the desired hydrological properties to the sub-grade base.

Once sub-grade base 110 is prepared in step 210, coarse pervious layer 120 is poured in step 220. Coarse pervious layer 120 is poured to a desired thickness. Coarse pervious layer 120 may be poured, for example, from 1 inch to 10 inches thick. In some embodiments, coarse pervious layer 120 may be poured 4.5 inches thick. After pouring coarse pervious layer 120, coarse pervious layer 120 is compacted and screeded to a desired level but is worked only as much as necessary to level it, to avoid compromising the voids in the layer. In some embodiments, a roller screed may be used to compact and screed the surface of coarse pervious layer 120.

Once coarse pervious layer 120 is finished, seal and cure step 230 may be performed. In seal and cure step 230, an acrylic seal, as described elsewhere herein, is applied to coarse pervious layer 120. The acrylic seal cure may be applied to retain moisture and promote proper curing of coarse pervious layer 120.

In step 240, binder layer 130 is applied to coarse pervious layer 120. Binder layer 130, as described elsewhere herein, may be a sealant, such as a latex acrylic sealant, and it may be sprayed, poured, spread, or otherwise applied to coarse pervious layer 120. After application to coarse pervious layer 120, binder layer 130 retains water within coarse pervious layer 120 to promote proper curing. To ensure proper curing of coarse pervious layer 120, coarse binder layer 130 may be applied to coarse pervious layer 120 following pouring coarse pervious layer 120. Binder layer 130 provides structural support and helps mitigate cracking or other undesirable consequences of freeze-thaw cycles and promotes desirable curing of decorative pervious layer 140. In some embodiments, by applying binder layer 130, the use of plastic as a vapor barrier, which is common in concrete finishing, is not necessary. In some embodiments, plastic as a vapor barrier may be advantageously used.

After a specified cure time, in step 250, decorative pervious layer 140 is poured. Decorative pervious layer may be compacted and worked using a power trowel with a float pan. Decorative pervious layer 140 may be poured, for example, from 0.5 to 2 inches thick. In some embodiments decorative pervious layer 140 may be poured 1.5 inches thick. A sealer, such as an acrylic cure seal, similar to that used on coarse pervious layer 120 may be applied as a vapor barrier to decorative pervious layer 140 in order to retain moisture and promote proper curing.

After pouring decorative pervious layer 140, in step 260 the decorative aggregate 145 comprising decorative pervious layer 140 is exposed. The exposure of decorative aggregate 145 may be facilitated by applying a retarder to decorative pervious layer 140 within about 30 minutes of placing decorative pervious layer 140. The retarder acts to slow the hydration and curing of at least a top portion of the decorative pervious layer, which will facilitate removal for exposing decorative aggregate 145. The retarder may comprise a polymer based surface retarder. At least a top portion of decorative pervious layer 140 is removed by brushing, sweeping, spraying, sponge rolling, water blasting, or other similar method. A sufficient amount of decorative pervious layer 140 is removed in order to reveal at least the top surface of the particles of decorative aggregate 145. Once at least a top portion of decorative pervious layer 140 is removed, portions of the particles of decorative aggregate 145 become visible on the surface of decorative porous layer 140. After exposing decorative aggregate 145, decorative pervious layer 140 is washed to remove dirt, debris, loose concrete, and other material that may be on the surface of decorative pervious layer 140.

In some embodiments, rather than incorporating the decorative aggregate 145 in the decorative pervious layer 140, the decorative aggregate 145 may be broadcast over the surface of decorative pervious layer 140 as a seeded aggregate, prior to decorative pervious layer 140 being fully cured. The decorative aggregate 145 may then be worked into the top surface of decorative pervious layer 140, such that decorative aggregate 145 is partially exposed, and embedded within decorative pervious layer 140.

In step 270, a decorative layer sealer 150 is applied to decorative pervious layer 140 and the exposed decorative aggregate 145 on the surface thereof. Decorative layer sealer may be applied following exposing decorative aggregate 145 in step 260.

It is possible that the void space of decorative pervious layer 140 may eventually become infiltrated, plugged, obstructed or otherwise filled by particles of dirt, dust, debris or other material. If the void space of decorative pervious layer 140 becomes filled, obstructed, or plugged, the water percolation rate may be lowered. To remove these particles, decorative pervious layer 140 may be periodically washed, swept, vacuumed, or otherwise cleaned.

EXAMPLES

Example 1

Coarse Pervious Layer 400 pounds of cement is mixed with 100 pounds of fly ash, 2558 pounds of 1-inch coarse aggregate and 180 pounds of water. 3 lbs of cellulose fibers and 3 gallons of RECOVER® hydration stabilizer manufactured by Grace Concrete Products are added to the mixture. The concrete mixture is poured into a form, and leveled by screeding, to leave a 4.5 inch thick layer. The mixture forms one cubic yard of coarse aggregate layer having a void space of about 23%.

Example 2

Coarse Pervious Layer 500 pounds of cement is mixed with 100 pounds of fly ash, 1600 pounds of ½-inch crushed coarse aggregate, 1000 pounds of ⅜" coarse aggregate, and 183 pounds of water. 3 lbs of cellulose fibers and 3 gallons of RECOVER® hydration stabilizer are added to the mixture. The concrete mixture is poured into a form, and leveled by screeding. The mixture forms one cubic yard of coarse aggregate layer having a void space of about 20%.

Example 3

Coarse Pervious Layer 504 pounds of cement is mixed with 126 pounds of fly ash, 2718 pounds of ⅜" coarse aggregate, and 183 pounds of water. 3 lbs of cellulose fibers and 3 gallons of RECOVER® hydration stabilizer are added to the mixture. The concrete mixture is poured into a form, and leveled by screeding. The mixture forms one cubic yard of coarse aggregate layer having a void space of about 16%.

Example 4

Decorative Pervious Layer 500 pounds of cement is mixed with 100 pounds of fly ash, 2684 pounds of decorative granite aggregate, and 180 pounds of water. 3 pounds of cellulose fibers, 3 pounds of HydroMax® from ProCure Systems, and 3 gallons of RASIR™ manufactured by Grace concrete products are added and mixed. The mixture makes 1 cubic yard of decorative pervious layer having a void space of about 18%.

Example 5

Decorative Pervious Layer 500 pounds of cement is mixed with 100 pounds of fly ash, 2366 pounds of decorative granite aggregate, 210 pounds of #1 glass, and 180 pounds of water. 3 pounds of cellulose fibers, 3 pounds of HydroMax® from ProCure Systems, and 3 gallons of EUCON Integral ARC™ are added and mixed. The mixture makes 1 cubic yard of decorative pervious layer having a void space of about 20%.

Example 6

Decorative Pervious Layer 255 pounds of cement is mixed with 180 pounds of fly ash, 2330 pounds of decorative granite aggregate, 180 pounds of fine aggregate, and 180 pounds of water. 2 pounds of cellulose fibers, 2 pounds of HydroMax® from ProCure Systems, and 2 gallons of EUCON Integral ARC™ are added and mixed. The mixture makes 1 cubic yard of decorative pervious layer having a void space of about 22.5%.

Example 7

Decorative Pervious Layer 500 pounds of cement is mixed with 100 pounds of fly ash, 2612 pounds of #1 glass, and 180 pounds of water. 3 pounds of cellulose fibers, 3 pounds of HydroMax® from ProCure Systems, and 3 gallons of RASIR™ are added and mixed. The mixture makes 1 cubic yard of decorative pervious layer having a void space of about 15%.

Example 8

Decorative Pervious Layer 880 pounds of cement is mixed with 38 pounds of silica fume, 3520 pounds of decorative granite aggregate, and 246 pounds of water. 3 pounds of cellulose fibers, 3 pounds of HydroMax® from ProCure Systems, and 3 gallons of RASIR™ are added and mixed. The mixture makes about 1.3 cubic yards of decorative pervious layer having a void space of about 23%.

It will be understood by those having skill in the art that the above examples are illustrative only. Quantities and components other than or in addition to those described in these examples may be used without departing from the scope of the present disclosure.

What is claimed is:

1. A pervious concrete system comprising:

a sub-grade layer;

a coarse pervious layer, disposed on the sub-grade layer, comprising:

a coarse aggregate, a cement mixture, a fiber material, and water of hydration, wherein the coarse aggregate, cement mixture, fiber material and water create a pervious concrete layer;

a binder layer, the binder layer being disposed on the coarse pervious layer;

a pervious decorative top layer, disposed on the binder layer, comprising:

a decorative aggregate, the decorative aggregate having an average particle size smaller than that of the coarse aggregate, a pozzolan, an internal curing admixture, a fiber material, and water of hydration, wherein the decorative aggregate, pozzolan, internal curing admixture, fiber material are distributed throughout the decorative top layer and create a pervious concrete layer.

2. The pervious concrete system of claim 1, wherein the binder layer comprises an acrylic.

3. The pervious concrete system of claim 1 wherein the decorative top layer further comprises an alkali silica reaction control admixture.

4. The pervious concrete system of claim 1 further comprising a top seal layer comprising a lithium sealer.

5. The pervious concrete system of claim 1 wherein the decorative aggregate is a decorative glass.

6. The pervious concrete system of claim 3 wherein the alkali silica reactivity control admixture comprises lithium nitrate.

7. The pervious concrete system of claim 1 wherein the decorative pervious layer further comprises a hydration stabilizer.

8. The pervious concrete system of claim 7 wherein the hydration stabilizer comprises an aqueous hydroxycarboxylic acid salt solution.

9. The pervious concrete system of claim 1 wherein the coarse aggregate has an average particle size from about ⅜ inch to about 1½ inches.

10. The pervious concrete system of claim 1 wherein the pozzolan is fly ash.

11. The pervious concrete system of claim 1 wherein the coarse aggregate layer is formed having a void space of about 18% to about 22%.

12. The pervious concrete system of claim 1 wherein the decorative pervious layer is formed having a void space of about 15% to about 25%.

13. The pervious concrete system of claim 1 wherein the percolation rate of water through the pervious concrete system is greater than about 5 gallons per hour per square foot.

14. The pervious concrete system of claim 1 wherein the design water to cementitious material ratio in the coarse pervious layer is about 0.25 to about 0.4.

15. The pervious concrete system of claim 1 wherein the design water to cementitious material ratio in the decorative pervious layer is about 0.25 to about 0.45.

16. A method of forming a pervious concrete system comprising:

establishing a sub-grade layer on which the pervious concrete will be formed;

disposing a coarse pervious layer on the sub-grade layer, wherein the coarse aggregate layer comprises cement, a relatively coarse aggregate and a fiber;

retaining water of hydration in the coarse pervious layer during curing by applying an acrylic binder layer to the coarse pervious layer;

disposing a decorative pervious layer on to the acrylic binder layer, the decorative pervious layer comprising a cement, a relatively fine decorative aggregate, fly ash, and an internal curing admixture;

retarding curing of a top surface of the decorative pervious layer by applying a retarder, and allowing a remaining portion of the to cure to a greater extent than the top surface; and thereafter mechanically removing at least a portion of the top surface of the decorative pervious layer to at least partially expose the decorative aggregate; and washing the decorative top layer.

17. The method of claim 16 wherein the decorative pervious layer further comprises an alkali silica reactivity control admixture.

18. The method of claim 16 further comprising applying a top seal layer to the decorative pervious layer.

19. The method of claim 16 wherein mechanically removing comprises brushing the surface of the decorative pervious layer.

20. The method of claim 16 wherein at least partially exposing the decorative aggregate comprises exposing at least a top surface of the decorative aggregate.

* * * * *

UNITED STATES PATENT AND TRADEMARK OFFICE

CERTIFICATE OF CORRECTION

PATENT NO. : 8,312,690 B1
APPLICATION NO. : 13/443799
DATED : November 20, 2012
INVENTOR(S) : Byron A. Klemaske, II et al.

It is certified that error appears in the above-identified patent and that said Letters Patent is hereby corrected as shown below:

| Issued Patent Column | Line | Description of Discrepancy |
|---|---|---|
| In the Drawings: | | |
| Sheet 2 of 2 (Reference Numeral 230) (FIG. 2) | 2 | Change "COURSE" to --COARSE--. |
| In the Specifications: | | |
| 4 | 5 | Change "cementitous" to --cementitious--. |
| 5 | 13 | Change "12Q" to --120--. |
| 6 | 45 | Change "gallon/" to --gallons/--. |
| 7 | 17 | Change "cementitous" to --cementitious--. |
| In the Claims: | | |
| 2, 12 | 16-18 and 18-20 | Change "allowing a remaining portion of the to cure to a greater extent than the top surface;" to --allowing a remaining portion of the decorative pervious layer to cure to a greater extent than the top surface;--. |

Signed and Sealed this
Sixteenth Day of July, 2013

Teresa Stanek Rea
*Acting Director of the United States Patent and Trademark Office*